US005765910A

United States Patent [19]

Larkin et al.

[11] Patent Number: 5,765,910

[45] Date of Patent: *Jun. 16, 1998

[54] PROGRAMMED MOTION WORK STATION

[76] Inventors: Stephen F. Larkin, 2233 Martin, #312, Irvine, Calif. 92715; Alan A. Booth, 10551 Wilshire Blvd., #603, Los Angeles, Calif. 90024

[ * ] Notice: The terminal 24 months of this patent has been disclaimed.

[21] Appl. No.: 102,471

[22] Filed: Aug. 5, 1993

[51] Int. Cl.[6] ..... A47B 39/00

[52] U.S. Cl. ..... 297/172; 297/173; 297/217.3; 297/344.1; 297/362.12

[58] Field of Search ..... 297/217, 135, 297/143, 140, 172, 170, 174, 188, 344.1, 344.12, 344.13, 344.16, 344.17, 344.18, 344.2, 361.1, 362.13, 423.38, 463, 344.11, 362.12, 362.14, 330, 344.15, 138, 141, 142, 173, 217.1, 217.3, 217.7, 463.1, 463.2, 188.01, 188.21; 108/7, 50, 147

[56] References Cited

U.S. PATENT DOCUMENTS

| | | | |
|---|---|---|---|
| 1,283,733 | 11/1918 | Gorny | 297/140 X |
| 2,098,655 | 11/1937 | De Lisle | 297/174 |
| 2,606,380 | 8/1952 | Buhr et al. | 297/174 |
| 3,712,672 | 1/1973 | De Graaf | 297/362.14 X |
| 4,805,538 | 2/1989 | Fisher et al. | 108/7 |
| 4,953,664 | 9/1990 | Vrooman et al. | 297/143 X |
| 4,981,085 | 1/1991 | Watt | 108/147 |
| 5,054,852 | 10/1991 | Tholkes | 297/172 |
| 5,098,160 | 3/1992 | Moore et al. | 297/174 X |
| 5,101,736 | 4/1992 | Bommarito et al. | 108/7 |
| 5,174,223 | 12/1992 | Nagy et al. | 108/50 |

FOREIGN PATENT DOCUMENTS

| | | | |
|---|---|---|---|
| 2261086 | 6/1974 | Germany | 297/174 |
| 2517578 | 10/1976 | Germany | 297/344.13 |

*Primary Examiner*—Milton Nelson, Jr.
*Attorney, Agent, or Firm*—Roy A. Ekstrand

[57] ABSTRACT

A work station includes a work table and chair defining a work station geometry. A plurality of adjustable elements are utilized within the work station to facilitate the variation of the work station geometry. A controller is coupled to the adjustable elements of the work station to apply gradual long term motion profile signals to the adjustable elements of the work station. The work station geometry is varied in response to the imposition of the motion profile signals upon the adjustable elements of the work station to provide substantially imperceptible changes of the work station operator's physical position to avoid or minimize the many maladies associated with restricted or limited motion operation within work stations.

6 Claims, 2 Drawing Sheets

PROGRAMMED MOTION WORK STATION

FIELD OF THE INVENTION

This invention relates generally to human work environments and particularly to specialized working environments often referred to generally as work stations.

BACKGROUND OF THE INVENTION

One of the emerging consequences of the technological development in the workplace has been the emergence of highly specialized machines and machine control environments. These machines and machine controls such as computer controlled systems have greatly increased the productivity and efficiency of workers by grouping substantial operative and control functions within a single compact environment minimizing the amount of movement and travel required by the worker in controlling diverse and complex functions. As workplace architects and creators have endeavored to further increase the effectiveness and efficiency of workers, greater numbers of controls and functions have been more densely grouped into smaller and smaller workspace type areas often referred to as work stations. Such work stations have achieved considerable variation and have included manufacturing system control facilities, computer work stations for information process, secretarial and administrative office environments as well as other facilitates throughout much of the modern industrial scene including inspection and fabrication stations on assembly line type facilities or the like.

While such highly efficient and compact work station environments have greatly increased worker productivity and efficiency, the burdens imposed upon the worker in a work station environment which essentially limits the ranges of motions encountered by the worker has also given rise to substantial risks of injury and other problems. In particular, the tendency for such work stations to utilize a restricted seating portion for the worker and the manipulation of densely compacted controls such as a computer keyboard or the like has given rise to a variety of maladies such as the well known carpal tunnel syndrome as well as a variety of musculo-skeletal ailments generally referred to as repetitive motion syndrome. One of the most common examples of such problems is the painful injury which often afflicts those operating computer keyboards for extended periods of time as the repeated high speed limited motion of the computer operator's fingers gives rise to the carpal tunnel syndrome type injury. Other familiar problems includes back and neck stress and eye strain as computer operators maintain a fixed position staring at a computer display monitor or the like.

In attempting to meet these problems, practitioners in the art have endeavored to provide work station environments which are more ergonomic and which provide improved support and adjustability of the operating environment to suit the physical dimensions and characteristics of the operator. Toward this end, practitioners have provided work station environments in which the user is able to adjust the various operating dimensions of the workspace environment such as the table height, the keyboard height, the height of footrest and chair seating surfaces as well as the angle of chair back supports and the distance to the worktable and so on.

For example, U.S. Pat. No. 5,098,160 issued to Moore, et al. sets forth an ERGONOMIC SEATING SYSTEM APPARATUS which includes a linear alignment member with an interconnected seating device such as a chair. An adjustable footrest is provided in combination with the linear adjustment and alignment member. The chair and linear alignment member and footrest are positioned with respect to a workplace environment such as a desk and computer. The user is able to adjust the chair position and height as well as the footrest height independently to optimize the ergonomic position for the user.

U.S. Pat. No. 4,779,922 issued to Cooper sets forth a WORK STATION SYSTEM in which a planar base supports a multiply articulated chair having an angularly movable backrest and various adjustable independently movable support pads and surfaces. An angularly movable support is coupled to the chair and includes a computer monitor and keyboard all capable of independent adjustment.

U.S. Pat. No. 4,880,270 issued to Cooper sets forth a WORK STATION SYSTEM similar to that set forth in the above-mentioned U.S. Pat. No. 4,779,922 and which is a continuation-in-part thereof.

U.S. Pat. No. 5,106,141 issued to Mostashari sets forth a MOTORIZED MOBILE OFFICE for use in a van-type vehicle or the like. The interior of the van is configured to receive and support a complete work station including a support chair and a computer keyboard support together with additional surrounding work surfaces.

U.S. Pat. No. 5,122,786 issued to Rader sets forth ERGONOMIC KEYPADS FOR DESKTOP AND ARMREST APPLICATIONS in which a pair of left and right ergonomic keypads may be separately positioned on a desktop or armrest of a chair to permit the user to operate the keypads while assuming a more comfortable and natural hand and wrist position. The separate keypads may be hingedly interlockingly joined to function as a compact unitary keyboard for desktop use.

U.S. Pat. No. 4,585,363 issued to McGuire sets forth a THERAPEUTIC AID for use by a patient in developing fine, medium and gross arm movements. The device includes a pair of elongated adjustable length arms pivotally coupled at their junction and securable at one end to a chair backrest or the like. A pen or other therapeutic apparatus may be secured to the remaining end of the pivotal arm combination and serves as a guide for arm and hand movement on the part of the user.

While the foregoing described prior art devices have provided improvement over fixed inflexible work station environments, there remains nonetheless a continuing need in the art for work station environments and apparatus therefor which provide further attention to the physical needs of the user and which protect the user more substantially against the limited motion and confined motion types of injuries such as carpal tunnel syndrome or repetitive motion syndrome.

SUMMARY OF THE INVENTION

Accordingly, it is a general object of the present invention to provide an improved work station. It is a more particular object of the present invention to provide an improved work station which tends to minimize or prevent injury to the user resulting from limited and repetitive motion.

In accordance with the present invention, there is provided a programmed motion work station comprising: a worktable having a work surface and means for supporting the work surface; a chair having a seating surface; and motion means for raising and lowering the seating surface of the chair in accordance with a long term gradual motion profile.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
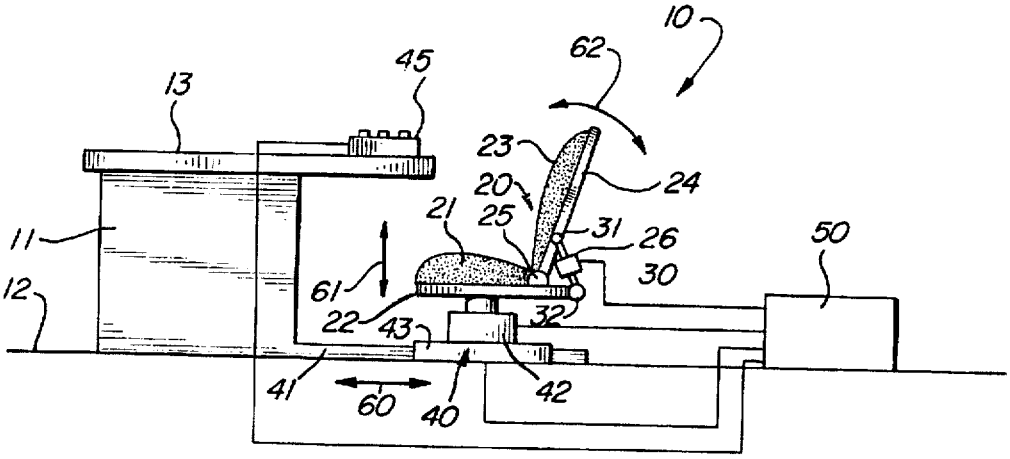
FIG. 1 sets forth a diagrammatic representation of the present invention programmed motion work station.

FIG. 1 sets forth a diagrammatic view of a work station constructed in accordance with the present invention and generally referenced by numeral 10. Work station 10 includes a work desk 11 constructed in accordance with conventional fabrication techniques and resting upon a typical floor surface 12. Desk 11 includes a generally planar desktop 13 which forms a typical work station work surface. While not seen in FIG. 1, desktop 13 may support a plurality of conventional work station apparatus such as that typically found in offices or the like including for example a computer and computer keyboard. A chair 20 includes a seat support 22 having a seat 21 secured thereto together with a back support 24 pivotally coupled to seat support 22 by a pivotal attachment 25. Back support 24 supports a back cushion 23 in accordance with conventional fabrication techniques. A back adjuster 26 is coupled to back support 24 by a pivotal attachment 31 and to seat support 22 by a pivotal attachment 32. Back adjuster 26 includes a motor driven expander 30 also constructed in accordance with conventional fabrication techniques. Chair 20 further includes a chair base 40 having an expandable height adjuster 42 secured thereto and extending upward therefrom. Height adjuster 42 comprises an expandable motor driven element of conventional fabrication which is secured to a chair support 43 which in turn is secured to the underside of seat support 22. A horizontal track 41 is secured to floor 12 and to the lower portion of desktop 13 and extends beneath chair base 40. Chair base 40 includes conventional motor driven apparatus (not shown) which engages track 41 and which moves chair base 40 and chair 20 upon track 41 either toward or away from desk 11. A motion controller 50 is coupled to back adjuster 26, height adjuster 42 and chair base 40 in an operational relationship in which controller 50 is operable to energize back adjuster 26, height adjuster 42 and chair base 40 in accordance with the present invention to provide predetermined motion thereof. A control panel 45 is supported upon desktop 13 and is also coupled to controller 50.

In operation, controller 50 preferably includes a microprocessor controller which provides output signals to the motor driven apparatus within chair base 40, height expander 42 and back adjuster 26 to energize the motor driven apparatus therein in accordance with a predetermined motion profile. In addition, control panel 45 provides user input capability to controller 50 which, for example, may determine the motion profile selected and the time duration and amplitude constraints upon the motion profile. In accordance with an important aspect of the present invention, controller 50 operates to provide motion profiles for work station 10 which are extremely gradual and preferably undetectable by the user but which cycle the user through a variety of position changes over an extended period of time. It has been found that the use of long term imperceptible or slightly perceptible motion changes in the configuration of the work station provide substantial reduction of the various repetitive motion or limited motion difficulties encountered in work stations lacking this slow programmed motion capability. Thus, for example, controller 50 produces output signals applied to chair base 40 which slowly move chair base 40 and therefore chair 20 and the operator seated therein in the directions indicated by arrows 60 toward desktop 13 or away from desktop 13 thereby producing slow barely perceptible or imperceptible changes in the distance between chair 20 and desktop 13. These slow long term changes are not disturbing to the user but provide substantial changes of the user's physical position when seated in chair 20 working at desk 11. Similarly, controller 50 further provides motion profile signals to height adjuster 42 which energizes adjuster 42 to move chair 20 vertically in the directions indicated by arrows 61. Thus, with long term slow imperceptible or barely perceptible changes of the seating height of chair 20, the vertical distance to desktop 13 and the seat to floor distance imposed upon the operator seated in chair 20 is gradually changed taking the user through an extended motion change without disturbing the user in any manner. Similarly, controller 50 produces motion profile signals applied to expander 30 which pivot back support 24 about pivot 25 with respect to seat 21 thereby changing the support angle of back 23 in the pivotal directions indicated by arrows 62. Once again, it should be emphasized that the motion profile preferred in moving back adjuster 26 to produce angular changes of seat back 23 is that of a slow imperceptible or barely perceptible rate of change which over a long term takes the user through a substantial variation of physical positions.

Thus, in the embodiment of the present invention set forth in FIG. 1, controller 50 produces a plurality of motion profile signals which control otherwise conventional work station adjustment apparatus such as height adjuster 42, chair base 40 and back adjuster 26 to cycle the operator through a plurality of work station configuration changes which avoid or substantially minimize the difficulties to the work station user arising from fixed position work station use. It will be apparent to those skilled in the art that the fabrication of the movable units within the present invention system is well within the state of the art and need not be set forth in greater detail herein. In essence, chair base 40, height adjuster 42 and back adjuster 26 may comprise virtually any of the presently available motor driven work station adjustment units presently utilized such as those set forth in the above-referenced patents described and referred to in the background of the invention.

In its simplest form, controller 50 provides a source of position signals which are varied in accordance with long term motion profiles such as those set forth below in FIG. 4 to control height adjuster 42 in cycling the chair height of chair 20, chair base 40 in cycling the chair to desk horizontal distance of work station 10, and back adjuster 26 in cycling the angle of back 23 of chair 20.

It will be apparent to those skilled in the art that controller 50 may utilize conventional control systems (not shown) in providing motion profile signals of the type utilized in the present invention. It will be equally apparent to those skilled in the art that a variety of different control systems may be utilized for controller 50 without departing from the spirit and scope of the present invention. It will also be apparent to those skilled in the art that because the present invention work station system may be utilized in combination with a great variety of position adjustable work stations, the work station shown in FIG. 1 is merely illustrative and other types of position adjustable work station elements may be utilized without departing from the spirit and scope of the present invention.

Figure 2:
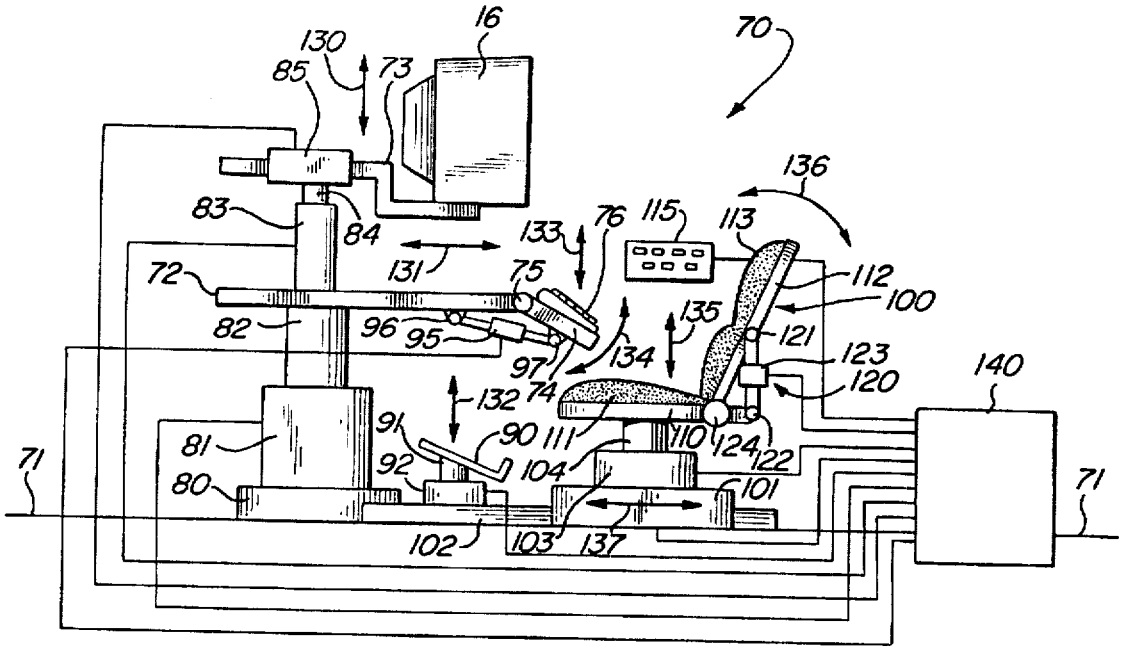
FIG. 2 sets forth a diagrammatic representation of an alternate embodiment of the present invention programmed motion work station.

FIG. 2 sets forth a more complex embodiment of the present invention programmed motion work station generally referenced by numeral 70. Work station 70 is supported upon a floor 71 and represents a typical computer work station utilizing the present invention system. A table base 80 is supported upon floor 71 and supports an upwardly extending table height adjuster 81. A table support 82 is coupled to height adjuster 81 and supports a planar work table 72. Work table 72 includes a keyboard support 74 coupled to work table 72 by a pivotal attachment 75. A keyboard adjuster 95 is coupled to the underside of work table 72 by a pivotal attachment 96 and is coupled to keyboard support 74 by a pivotal attachment 97. A conventional keyboard 76 is secured to and supported by keyboard support 74 in accordance with conventional fabrication techniques.

A monitor height adjuster 83 is secured to work table 72 and is coupled to a vertically extending support 84. A monitor distance adjuster 85 is secured to support 84 and receives a monitor support 73.

A footrest height adjuster 92 is supported upon floor 71 and includes an upwardly extending support 91 having an angled generally planar footrest 90 supported thereupon.

A chair 100 includes a chair base 101 secured to a chair track 102 which in turn is secured to floor 71. Chair base 101 is operatively coupled to chair track 102 to provide motion of chair base 101 with respect to track 102. A chair height adjuster 103 is supported upon base 101 and is coupled to a chair support 104. The latter is coupled to a seat support 110 which supports a conventional seat 111. Chair 100 further includes a back support 112 supporting a chair back 113 which is pivotally coupled to seat support 110 by a pivotal attachment 124. A chair back adjuster 123 includes an expandable adjuster 120 secured to back support 112 by a pivotal attachment 121 and secured to seat support 110 by a pivotal attachment 122.

A controller 140 includes a control panel 115 coupled to controller 140. In accordance with the present invention, controller 140 is operatively coupled to monitor distance adjuster 85, monitor height adjuster 83, keyboard adjuster 95, table height adjuster 81, footrest height adjuster 92, chair base 101, chair height adjuster 103 and chair back adjuster 123.

Figure 4:
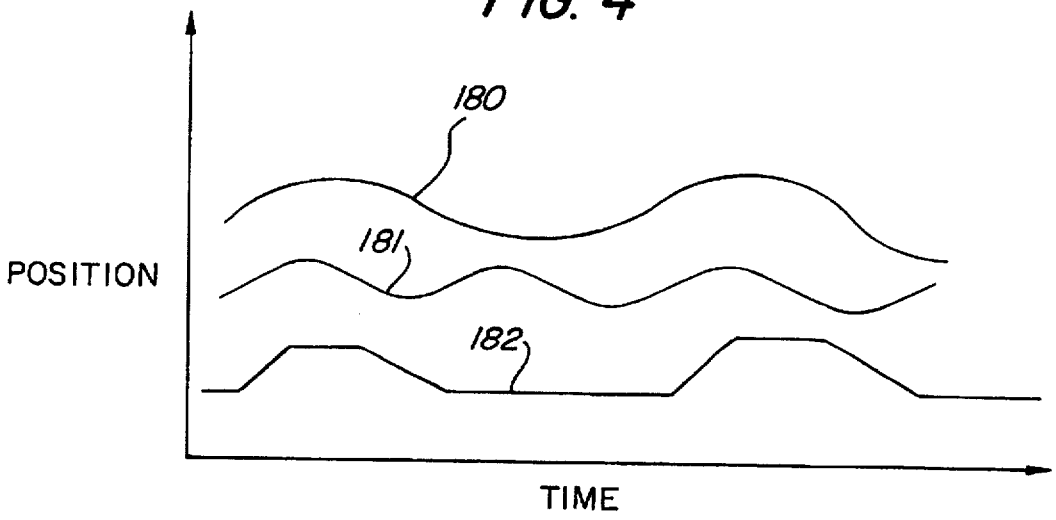
FIG. 4 sets forth a plurality of motion profile diagrams used in the present invention programmed motion work station.

In operation, controller 140 produces a plurality of motion profile signals such as those shown in FIG. 4 which are applied to the various motor driven adjusters within work station 70 to produce the above-described long term barely perceptible or imperceptible changes in the configuration of work station 70. The degree of motion changes and rate of motion change for each of the adjustable elements within work station 70 may be determined by user inputs at control panel 115. Alternatively, a stored program of motion profile signals may be housed within controller 140 and applied to the various expandable elements or adjusters within work station 70 on an automatic or preprogrammed basis or in accordance with a user selected program. In any event, the control signals provided by controller 140 applied to table height adjustment 81 provides height adjustment of work table 72. Similarly, the motion profile signals from controller 140 applied to monitor height adjuster 83 provides vertical motion of monitor 16 in the directions indicated by arrow 130. Signals from controller 140 applied to monitor distance adjuster 85 provide horizontal motion of monitor 16 in the directions indicated by arrows 131. In a similar fashion, the angular position of keyboard support 74 is changed in the directions indicated by arrows 134 as controller 140 applies motion profile signals to keyboard adjuster 95.

Motion profile signals applied by controller 140 to footrest height adjuster 92 produce vertical motion of footrest 90 in the directions indicated by arrows 132. Thus, in accordance with the present invention, the configuration of work table 72, keyboard 76, monitor 16 and footrest 90 are subjected to substantial relative variations as the expandable motor driven adjusters therein respond to the control signals provided by controller 140.

Chair 100 is subjected to similar motion profile configuration changes as controller 140 applies motion profile signals to chair base 101 moving chair 100 in the directions indicated by arrows 137 upon track 102. In addition, the application of motion profile signals by controller 140 to chair height adjuster 103 and back adjuster 120 provide long term changes of the height of chair 100 in the directions indicated by arrows 135 as well as the angular position of chair back 113 in the directions indicated by arrows 136.

Thus, as controller 140 produces long term motion profile signals applied to the various adjusters within work station 70, the entire configuration of work station 70 may be cycled through imperceptible or barely perceptible motion and configuration changes to improve the well being of the work station user. It will be apparent to those skilled in the art that a variety of motion profile combinations may be utilized in the present invention system to meet the user's need. For example, particular users may require greater movement and position changes of chair 100 while other users may require substantially smaller motions. It should be noted that the use of monitor 16 and keyboard 76 in work station 70 is representative of a typical computer work station. However, it will be apparent to those skilled in the art that a variety of similar apparatus may be utilized in work station 70 while receiving the benefit of the present invention system.

Figure 3:
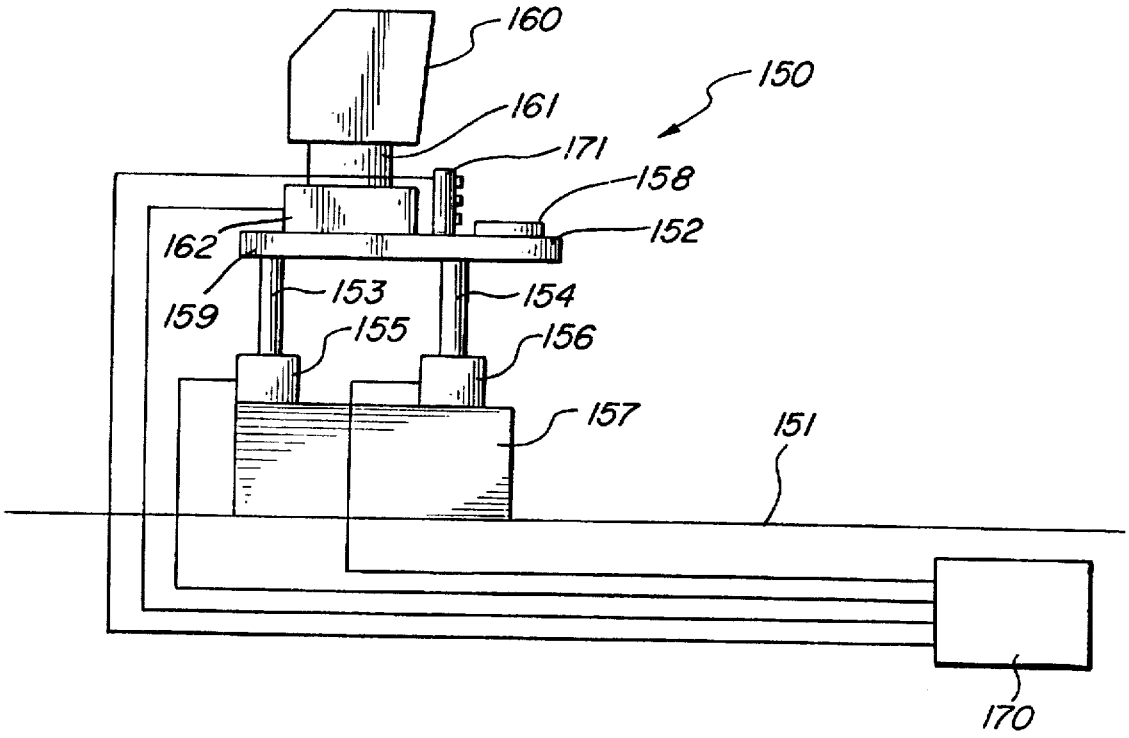
FIG. 3 sets forth a diagrammatic representation of a still further alternate embodiment of the present invention programmed motion work station.

FIG. 3 sets forth a still further alternate embodiment of the present invention in which a "stand-up" type work station is shown generally referenced by numeral 150. Work station 150 is stand-up in the sense that the operator generally operates the work station from a standing position upon a typical floor 151. Thus, work station 150 is representative of many manufacturing and testing type work stations and includes a table 152 having a base 157 supporting a pair of height adjusters 155 and 156. Height adjusters 155 and 156 in turn are coupled to a pair of supports 153 and 154 which in turn supports a generally planar work table 159. Work table 159 supports a monitor height adjuster 162 having a monitor support 161 supported thereby. A display monitor 160 is received upon and supported by monitor support 161. A control panel 171 is supported upon work table 159 and is coupled to a controller 170. An exemplary work piece 158 is rested upon the upper surface of work table 159 at a typical working position for the work station operator. Controller 170 is operatively coupled to table height adjusters 155 and 156 as well as monitor height adjuster 162.

In operation, the stand-up work station embodiment shown in FIG. 3 functions in substantial accord with the above-described embodiments in FIGS. 1 and 2. Thus, controller 170 produces a plurality of long term motion profiles signals which are applied to table height adjusters 155 and 156 to change the height of work table 159 in accordance with a gradual long term motion profile. Similarly, controller 170 provides motion profile signals to monitor height adjuster 162 to provide gradual long term vertical motion of monitor 160. Control panel 171 is utilized by the work station operator in setting upon the motion profile limits and character utilized by motion controller 170. Thus, it will be apparent from examination of FIG. 3 that the present invention programmed motion work station may be utilized in a stand-up environment of the type typically found in manufacturing work stations.

FIG. 4 sets forth a plurality of motion profile signals of the type utilized by the controller portions of the present invention programmed motion work station. In the diagram shown in FIG. 4, time is represented on the horizontal axis while position is represented on the vertical axis. Thus, for example, a sinusoidal motion profile 180 extending over a substantial length of time may be utilized as one of the motion profiles imposed by the controller portion of the present invention programmed motion work station. Sinusoidal variations have been found to be advantageous in that they lend themselves extremely well to long term gradual imperceptible changes which avoid disturbing the work station operator. Curve 181 shows a triangular waveform motion profile in which generally linear oppositely sloped portions are alternated to produce a generally linear "back and forth or up and down" motion within the work station. Curve 182 sets forth a trapezoidal motion profile in which oppositely sloped portions are interrupted by a constant period or interval. It has been found that certain portions of the work station are best controlled by utilizing relatively brief transition slopes in the motion profile separated by periods of relatively little motion corresponding to flat portions in the motion profile.

It will be apparent to those skilled in the art that a variety of motion profile signals may be generated by the controller portion of the present invention programmed motion work station without departing from the spirit and scope of the present invention. It will be equally apparent to those skilled in the art that a variety of motion profile combinations and amplitudes as well as motion profile durations may be utilized within the system in accordance with the particular needs of the user and the work station environment itself.

What has been shown is a programmed motion work station in which a plurality of generally conventional adjusters are operated under the control of a motion profile controller which applies gradual long term motion profile signals to the various adjustable elements within the work station environment. The objective is to provide gradual long term preferably imperceptible variation of the work station geometry and configuration in order to avoid various maladies arising from limited or restricted motion in work station environments.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A programmed motion work station comprising:

a work table having a work surface and means for supporting said work surface and wherein said work table includes a keyboard support pivotally coupled to said work surface and wherein a motion means includes means for pivoting said keyboard support in accordance with a long term gradual motion profile;

a chair having a seating surface and a back pivotally movable with respect to said seating surface, said chair being coupled to said work table; and said motion means, including a microprocessor controller, for raising and lowering said seating surface of said chair in accordance with a long term gradual motion profile and means for raising and lowering said work surface of said work table in accordance with a long term gradual motion profile and means for pivoting said back in accordance with a long term gradual motion profile, wherein said motion means includes means for moving said chair closer to and farther from said work table in accordance with a long term gradual motion profile.

2. A programmed motion work station as set forth in claim 1 wherein said work table includes a display monitor support and wherein said motion means includes means for raising and lowering said display monitor support in accordance with a long term gradual motion profile.

3. A programmed motion work station comprising:

a work table having a work surface and means for supporting said work surface and a keyboard support pivotally coupled to said work surface;

a chair having a seating surface and being coupled to said work table; and motion means, including a microprocessor controller, for raising and lowering said seating surface of said chair in accordance with a long term gradual motion profile and means for pivoting said keyboard support in accordance with a long term gradual motion profile.

4. A programmed motion work station as set forth in claim 3 wherein said motion means includes means for moving said chair closer to and farther from said work table in accordance with a long term gradual motion profile.

5. A programmed motion work station as set forth in claim 3 wherein said chair includes a back pivotally movable with respect to said seating surface and wherein said motion means includes means for pivoting said back in accordance with a long term gradual motion profile.

6. A programmed motion work station as set forth in claim 5 wherein said motion means includes means for raising and lowering said work surface of said work table in accordance with a long term gradual motion profile.

* * * * *